US005271195A

United States Patent [19]

Wahe

[11] Patent Number: 5,271,195

[45] Date of Patent: Dec. 21, 1993

[54] ADJUSTABLE GRATE

[76] Inventor: John M. Wahe, 1075 S. Garrison, No. 201, Lakewood, Colo. 80226

[21] Appl. No.: 901,733

[22] Filed: Jun. 22, 1992

[51] Int. Cl.[5] ..... F04F 17/06; E06B 3/68

[52] U.S. Cl. ..... 52/107; 52/632; 160/374; 49/55

[58] Field of Search ..... 52/107, 632, 106; 49/55; 160/371-374, 222; 24/525, 569

[56] References Cited

U.S. PATENT DOCUMENTS

| | | | |
|---|---|---|---|
| 94,963 | 9/1869 | King | 256/69 |
| 300,654 | 6/1884 | Smith . | |
| 958,481 | 5/1910 | Drinkwater | 49/55 |
| 1,074,153 | 9/1913 | Zimmerman | 160/374 |
| 1,695,810 | 12/1928 | Magill . | |
| 2,237,564 | 4/1941 | Keyes . | |
| 2,294,155 | 8/1942 | Boddy | 160/222 |
| 2,589,878 | 3/1952 | Shapiro . | |
| 2,800,957 | 7/1957 | Giglio et al. | 160/374 |
| 2,993,254 | 7/1961 | Larson | 24/569 |
| 3,046,613 | 7/1962 | Smith . | |
| 3,120,883 | 2/1964 | Greiling | 52/632 |
| 3,247,639 | 4/1966 | De La Rambelje | 52/632 |
| 3,262,487 | 7/1966 | Gustafson et al. . | |
| 3,703,791 | 11/1972 | Slade | 52/107 |
| 4,038,800 | 8/1977 | Daley, Jr. | 52/632 |
| 4,615,142 | 10/1986 | Reeves | 49/55 |
| 4,671,012 | 6/1987 | Merklinger et al. . | |
| 4,684,108 | 8/1987 | Bergagnini | 256/24 |
| 4,768,620 | 9/1988 | South | 52/632 |
| 4,817,334 | 4/1989 | Badger et al. | 49/55 |
| 5,070,647 | 12/1991 | Spialter | 49/55 |

FOREIGN PATENT DOCUMENTS

| | | | |
|---|---|---|---|
| 186835 | 9/1956 | Austria | 52/632 |
| 219822 | 8/1962 | Austria . | |
| 587085 | 11/1959 | Canada | 52/632 |
| 2548256 | 10/1975 | Fed. Rep. of Germany . | |
| 2913112 | 4/1979 | Fed. Rep. of Germany . | |

*Primary Examiner*—Carl D. Friedman
*Assistant Examiner*—Winnie Yip
*Attorney, Agent, or Firm*—Brian D. Smith

[57] ABSTRACT

An adjustable window well grate is disclosed. The grate includes a plurality of individually adjustable elongate members, each of which has first and second elongated slidable sections, preferably U-shaped stringer sections which are slidable relative to each other to enable one to easily adjust the overall length of the elongate member. By having the ability to adjust the length of each elongate member individually, the grate's overall shape can be adjusted to fit the contour of the window well. In addition to the elongate members, the adjustable grate includes a plurality of cross supports for supporting and connecting a plurality of the elongate members together.

18 Claims, 3 Drawing Sheets

ADJUSTABLE GRATE

TECHNICAL FIELD

The invention relates generally to window wells, security guards and barbecue grills and, more particularly, to window well grates.

BACKGROUND OF THE INVENTION

Many new building fire codes now require that window wells and their accompanying windows have a size which is sufficient to enable an individual to easily escape from the window well in the event of a fire or other emergency. To comply with the new regulations, many builders now install large window wells and accompanying windows having dimensions, i.e. a length and depth, which often exceed five feet. The width of these new window wells often exceeds two feet as well, as measured from the surface of the building's foundation to the center of the window well.

The sidewalls of these new window wells which are usually made out of galvanized, corrugated steel are installed in the dugout area around the building's foundation and fastened at their ends on opposite sides of the window to the building's foundation. After installing all of the window well sidewalls for a building, the dugout area around the building's foundation is usually backfilled with dirt and other debris until the surface of dugout area is level with the surface of the surrounding ground. In fact, to prevent water from seeping into the basement of the building, the dugout area is often backfilled to a level somewhat above the surface of the surrounding ground area.

Unfortunately, during the backfilling operation many of the window well sidewalls shift or bow slightly as a result of the force of the backfilled earth impacting against the sidewalls or perhaps because of the weight of the earth moving equipment which is used to backfill the dugout area. Whatever the cause, the result is that the shape or contour of the window well sidewalls often vary from sidewall to sidewall. For example, it has been found that a window well normally having a two foot width might, after backfilling, have a width as small as twenty inches or perhaps as great as twenty eight inches. When this occurs, the arcuate shape or contour of the sidewall changes, often significantly.

In view of the above problem, it will be appreciated that it is virtually impossible to manufacture a single size grate for these window wells. They simply shift or bow too much. Thus, the homeowner or building owner who desires to cover the building's window wells with grates typically has to have the grates custom made which is not only a difficult job for the window well grate installer but an expensive one as well for the homeowner.

Accordingly, it is an object of the present invention to provide an adjustable window well grate which can be easily adjusted by the average homeowner to fit the contour or shape of the new larger size window wells which have a tendency to bow or shift during backfilling around the building.

DISCLOSURE OF THE INVENTION

The present invention addresses the aforementioned problem by providing an adjustable grate for a window well and the like. The grate includes a plurality of adjustable elongate members wherein the length of each member is adjustable in the elongate direction, independently of the other adjustable elongate members. As used herein, "independently adjustable" means that each elongate member is capable of having its length individually adjusted. For example, one elongate member might be adjusted to a length of fifty eight inches while an adjacent elongate member could be independently adjusted to a different length of perhaps sixty inches.

In addition to the plurality of adjustable elongate members, the adjustable grate of the present invention includes cross support means for supporting and connecting the plurality of elongate members together. Securing means for securing the grate to a window well, preferably the window well's sidewall is also provided.

In the preferred embodiment of the present invention, each elongate member includes first and second slidable sections, which are preferably U-shaped stringers made from flat metal bar. The first and second slidable sections are slidable relative to each other to enable one to adjust the length of the elongate member. In the preferred embodiment where the first and second slidable sections are U-shaped stringers, the open ends of the U-shaped stringers slidable receive each other in an overlapping arrangement. By adjusting the degree to which they overlap one another, the overall length of the stringers can be adjusted. Accordingly, as illustrated in the drawings which are described in detail below, each elongate member comprised of the U-shaped stringers can be individually adjusted to enable one to adjust the overall shape of the grate, so that it conforms to the contour or shape of the window well.

The cross support means for supporting and connecting the elongate members together is also preferably adjustable along its length. In the preferred embodiment, the cross support means includes a left, a right and a central cross support, each of which is independently adjustable along its length. This adjustability makes it even easier for an individual to adjust the grate so that it fits the particular shape or contour of a window well. It will be appreciated that by adjusting the length of the cross supports, window wells having different widths can be accommodated. As previously mentioned, the width of today's new larger style "fire escape" type window wells may range anywhere from 20 to 28 inches.

The present invention also includes novel bolt means and brackets for connecting the elongate members and cross supports together which enable individuals to easily adjust the length of the elongate members and cross supports.

BRIEF DESCRIPTION OF THE DRAWINGS

The subject invention and its various objects and aspects will become more readily apparent from the following detailed description of the preferred embodiment which is illustrated by way of example in the accompanying drawings in which.

DETAILED DESCRIPTION OF THE PREFERRED EMBODIMENT

Figure 1:
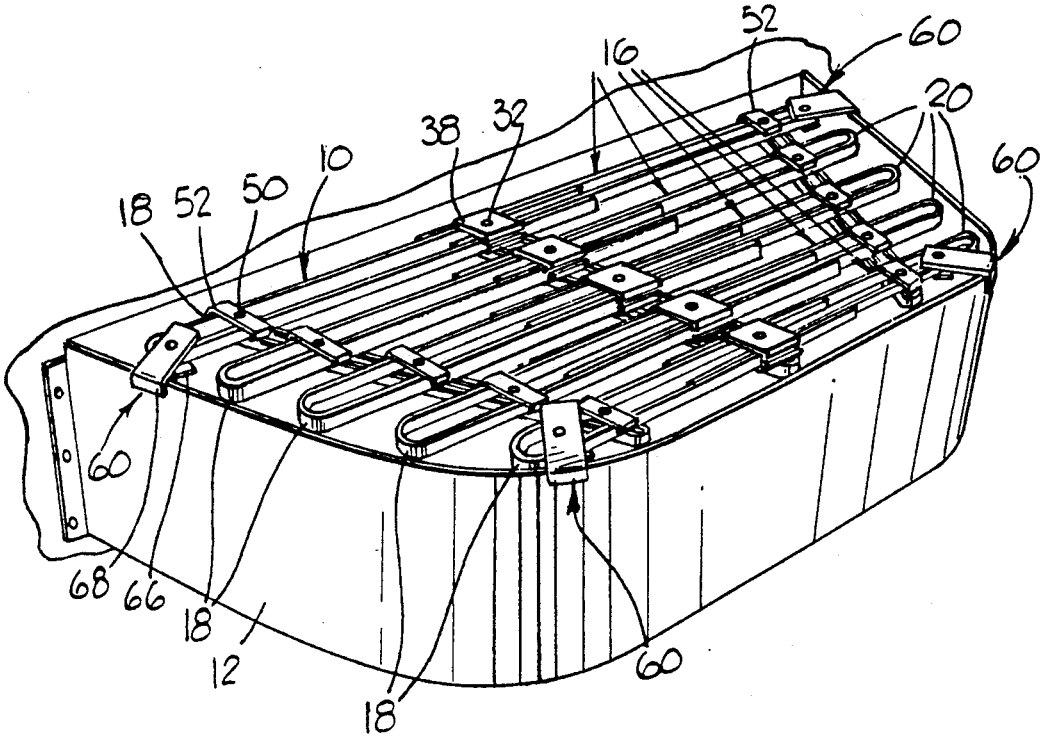
FIG. 1 is a perspective view of an adjustable window well grate of the present invention which is secured to the sidewall of a window well.
Figure 2:
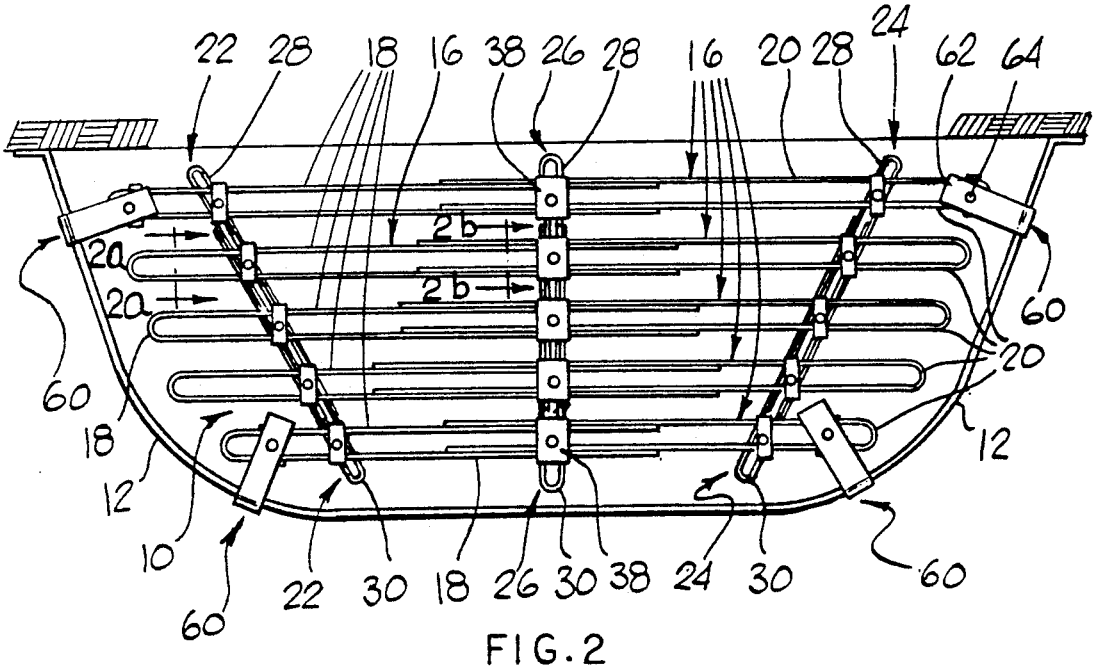
FIG. 2 is a top plan view of the window well grate illustrated in FIG. 1.
Figure 3:
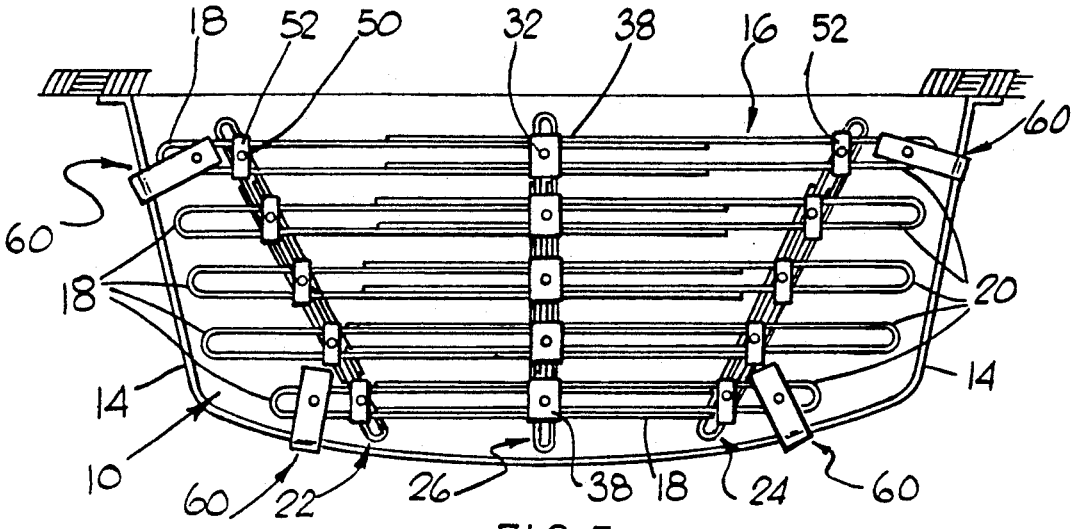
FIG. 3 is a top plan view of the adjustable window well grate illustrated in FIGS. 1 and 2 which has been adjusted to fit a smaller window well having a slightly different shape.

FIGS. 1 through 4 illustrate an adjustable window well grate 10 of the present invention. FIGS. 1 and 2 illustrate grate 10 secured to the sidewall 12 of a window well and FIG. 3 illustrates grate 10 after it has been adjusted to fit to the contour of another window well having a smaller and slightly differently shaped sidewall 14.

Grate 10 has plurality of elongate members 16, each of which is comprised of first and second slidable sections which are referred to herein as U-shaped stringers 18 and 20. Grate 10 further includes cross support means which is embodied in this preferred embodiment in the form of a left cross support 22, a right cross support 24, and a central cross support 26. While somewhat difficult to see in FIGS. 1 through 3, each cross support 22, 24 and 26 is also comprised of U-shaped slidable parts 28 and 30 which are similar to U-shaped stringers 18 and 20.

Figure 2A:
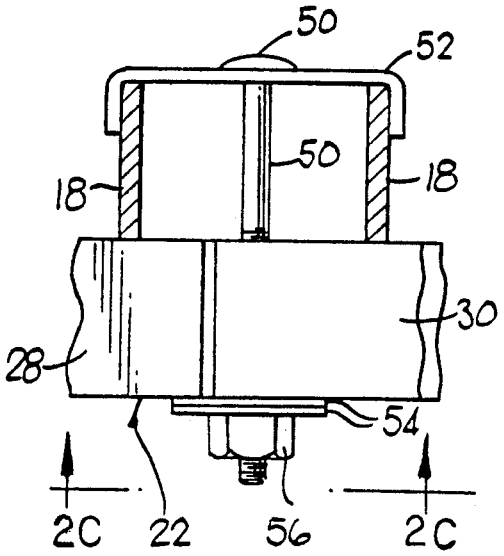
FIG. 2*a* is a cross-sectional view taken along lines 2*a*—2*a* of FIG. 2.
Figure 2B:
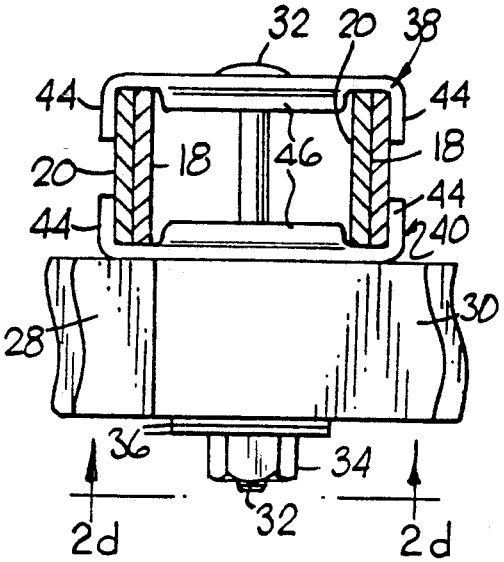
FIG. 2*b* is a cross-sectional view taken along lines 2*b*—2*b* of FIG. 2.
Figure 2C:
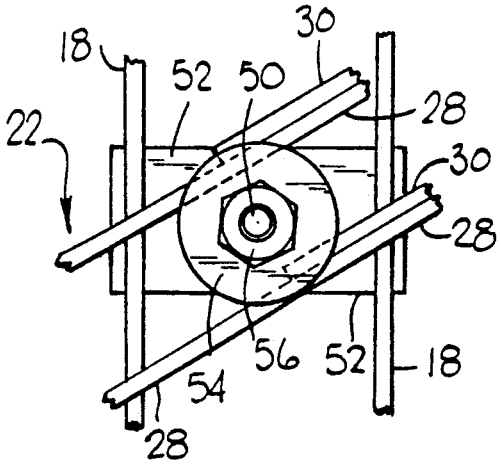
FIG. 2*c* is a bottom plan view taken along lines 2*c*—2*c* of FIG. 2*a*.
Figure 2D:
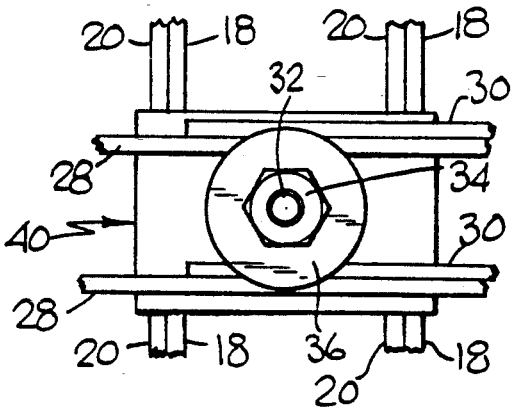
FIG. 2*d* is a bottom plan view taken along lines 2*d*—2*d* of FIG. 2*b*.
Figure 4:
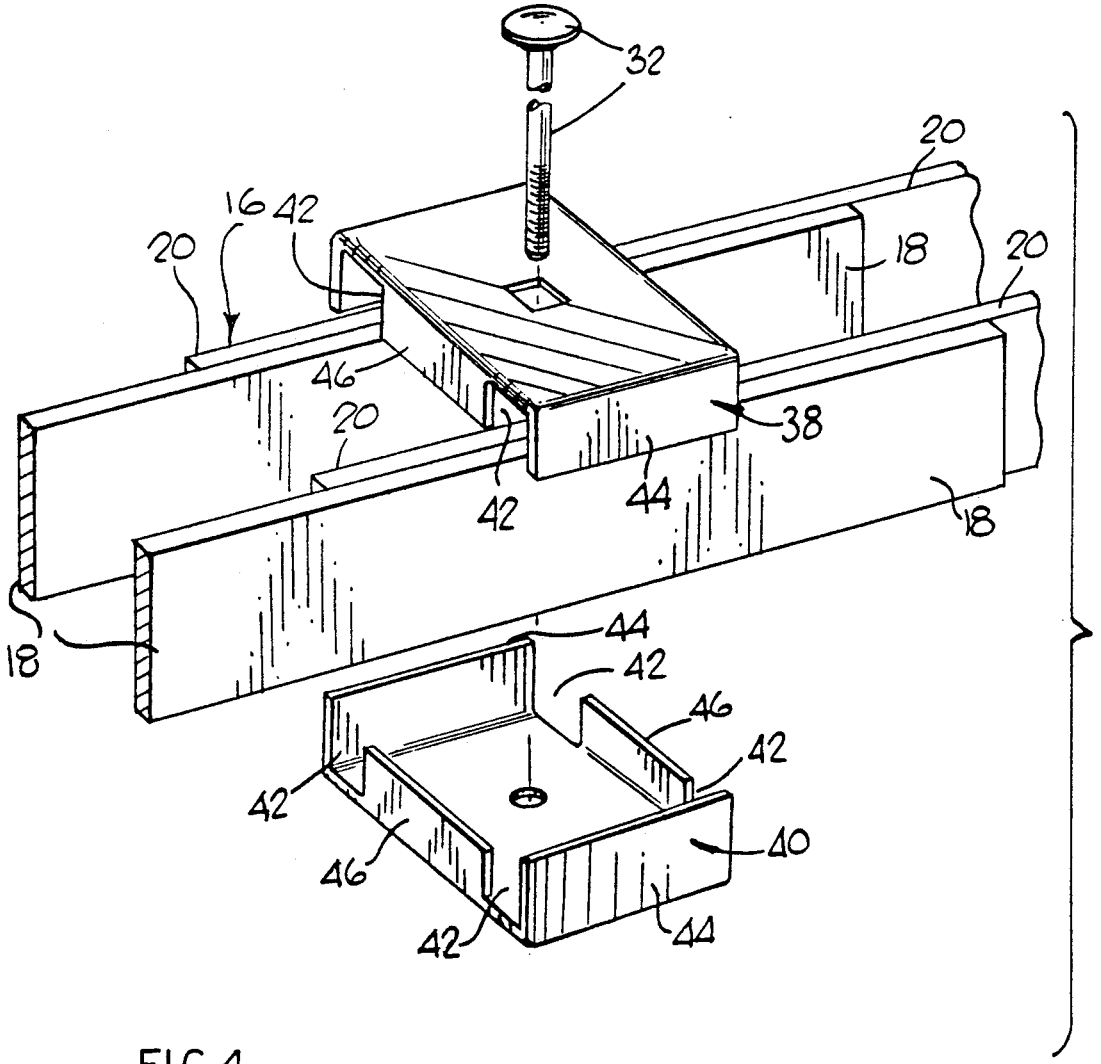
FIG. 4 is an exploded perspective view showing the novel channel brackets of the present invention for clamping together the overlapping ends of the U-shaped stringers of the present invention.

FIGS. 4, 2*b* and 2*d*, illustrate the bolt means (not numbered) for rigidly securing stringers 18 and 20 together and to central cross support 26. The bolt means includes a bolt 32, nut 34 and a pair of washers 36, in addition to a pair of upper and lower channel brackets 38 and 40, respectively. Channel brackets 38 and 40 are best illustrated in FIG. 4. Bolt 32 is inserted through holes (not numbered) of brackets 38 and 40 and through the gap located between cross support parts 28 and 30 of central cross support 26. Washers 36 are wide enough to span the gap and rest against the lower edges of cross support parts 28 and 30, as is best illustrated in FIG. 2*d*. As also illustrated, nut 34 has been threaded onto the threaded end of bolt 32 and as will be appreciated, when nut 34 is tightened, elongate member 16 and cross support 26 are secured to each other. In addition, it will be appreciated that stringers 18 and 20 are prevented from slidable movement relative to each other since the upper and lower brackets 38 and 40 clamp the stringers together. Similarly, the tightening of nut 34 also prevents slidable parts 28 and 30 of the central support from sliding relative to each other.

As best illustrated in FIG. 4, channel brackets 38, 40 are each provided with a pair of channels of 42 which receive the exposed edges of overlapping stringers 18, 20. Channels 42 keep the stringers aligned with each other when it is desired to slide the stringers relative to one another to adjust their overall length. It will further be appreciated that each channel bracket is provided with downwardly turned ends 44 and sides 46. In addition to defining channels 42, downwardly turned ends and sides 44, 46 serve to prevent the stringers from moving inwardly and spreading apart. It has also been discovered that the downwardly turned ends and sides 44, 46, enhance the overall rigidity of brackets 38 and 40.

FIGS. 2*a* and 2*c* illustrate the bolt means (not numbered) for securing both illustrated stringer 18 and stringer 20 to the left and right cross supports 22, 24. The bolt means includes a bolt 50, a U-shaped top clip 52, a pair of washers 54, and a nut 56. As illustrated, bolt 50 is inserted through a hole not shown but provided in top clip 52 and through the gap located between the opposing sides of stringer 18. Bolt 50 also passes through the gap located between left cross support parts 28 and 30. As also illustrated, washers 54 are located over the end of the bolt up against the underside edges of cross support parts 28 and 30. When nut 56 is threaded on the threaded end of bolt 50 and tightened, it will be appreciated that stringer 18 will be rigidly secured to the overlapping cross support parts 28 and 30. It will also be appreciated that since washer 54 has a diameter which spans the gap between cross support parts 28 and 30, the tightening of nut 56 also secures parts 28 and 30 together, thereby preventing their relative slidable movement.

FIG. 10 is also provided with four L-shaped members 60 for securing the grate (or mounting it on) the sidewall of the window well. L-shaped member 60 is secured to the U-shaped end of a stringer by inserting a bolt 64 through a hole (not shown) in the L-shaped member's free end 62 and a hole provided in a bottom lower clip 66 which is very similar to top clip 52 illustrated in FIG. 2*a* but located on the underside surface of the stringer. A nut (not illustrated) is threaded onto the threaded end of bolt 64 to tighten the L-shaped member to bottom clip 66, thereby tightly securing the L-shaped member to a stringer. The L-shaped end 68 of member 60 hookingly engages the side wall of a window well, as illustrated, when the grate is mounted on a window well. As will be appreciated, by loosening the bolt means attaching L-shaped member 60 to the end of a stringer, the L-shaped member can be slid along the length of the stringer and pivoted about its bolt 64 to precisely position the L-shaped member so that L-shaped end 68 fits snugly over the sidewall. By adjusting all four illustrated L-shaped members as described, window well grate 10 can be secured to the side wall so that it will not move or slide laterally within the window well.

As previously mentioned, FIGS. 2 and 3 illustrate adjustable grate 10 of the present invention attached to two differently sized and shaped side walls 12 and 14. To adjust the length of the respective elongate members 16 and cross supports 22, 24 and 26 in accordance with the present invention, one merely loosens the nut of each bolt means securing the elongate members to the cross supports. One then adjusts the length of each elongate member by sliding the stringers 18, 20 relative to each other until the desired length is obtained. The desired length should locate the U-shaped ends of each stringer close to the side wall of the window well. In addition and if necessary, the U-shaped parts of each cross support can be slid relative to each other to adjust the length of each cross support. As with the elongate members, the length of the cross support should locate the U-shaped ends of the cross support parts close to the side walls of the window well. After adjusting the lengths of the elongate members and cross supports as described, the nuts of the bolt means are tightened to rigidly secure the elongate members and cross supports in the desired position.

The invention has been described in detail with reference to a particular embodiment thereof, but it will be understood that various other modifications can be effected within the spirit and scope of this invention. For example, elongate members 16 could be comprised of telescoping tubular members instead of the illustrated solid flat metal bar stringers.

It is claimed:

1. An adjustable grate for a window well and the like comprising:

a plurality of adjustable elongate members wherein the length of each member is adjustable in its elongate direction independently of the others, each elongate member including a pair of first and second solid flat bar slidable sections, said first and second flat bar slidable sections of each pair being slidable relative to each other for adjusting the length of a said elongate member, each pair of said first and second slidable flat bar sections being spaced from each other and oriented with respect to each other such that the sides of said flat bar slidable sections are generally parallel to each other; and cross support means for supporting and connecting said plurality of elongate adjustable members together.

2. An adjustable grate as claimed in claim 1 wherein each first and second flat bar slidable sections is formed into an elongate, U-shaped stringer by bending the ends of a said flat bar section towards each other such that they face the same direction and are generally parallel to each other. the ends of a said stringer slidably receiving the ends of another stringer in an overlapping arrangement so that their overall length can be adjusted, thereby enabling the overall length of said elongate member to be adjusted.

3. A grate as claimed in claim 2 wherein each U-shaped stringer is formed from flat metal bar.

4. A grate as claimed in claim 5 wherein said flat bar stringers are positioned with respect to one another such that one edge of each lies in a first imaginary plane, while the other edge of each lies in a second imaginary plane and wherein the first and second imaginary planes are parallel to each other.

5. A grate as claimed in claim 1 further comprising bolt means for rigidly securing said first and second slidable sections together to prevent relative slidable movement therebetween when said bolt means is tightened and for permitting said slidable first and second sections of each elongate member to be slidably adjusted with respect to one another when said bolt means is untightened.

6. A grate as claimed in claim 1 wherein said cross support means includes a plurality of cross supports for supporting and connecting a plurality of said elongate members together.

7. A grate as claimed in claim 6 wherein said plurality of cross supports includes a left cross support, a right cross support, and a central cross support.

8. A grate as claimed in claim 9 further comprising bolt means for rigidly securing said elongate members to said cross supports.

9. A grate as claimed in claim 8 wherein said bolt means for rigidly securing said elongate members to said central cross support includes channel bracket means for clamping said first and second slidable sections together to prevent relative slidable movement therebetween when said bolt means is tightened and for permitting said first and second slidable sections to be slidably adjusted with respect to one another when said bolt means is untightened.

10. A grate as claimed in claim 9 wherein both said first and second slidable sections are elongate, U-shaped stringers, the open ends of which receive each other so that their overall length can be adjusted, thereby enabling one to adjust the overall length of said elongate member, and wherein said channel bracket means includes upper and lower channel brackets, each of which defines a pair of channels for receiving the overlapped open ends of said stringers.

11. The grate as claimed in claim 10 wherein said bolt means for securing said elongate members to said left and right cross supports includes a U-shaped clip for receiving the opposing sides of a U-shaped stringer.

12. An apparatus as claimed in claim 6 wherein each cross support is generally elongate and wherein each cross support includes means for adjusting its elongate length.

13. An adjustable grate as claimed in claim 6 wherein each cross support is elongate and has first and second elongate slidable parts which are slidable relative to each other for adjusting the elongate length of the cross support.

14. An adjustable grate as claimed in claim 13 wherein both said first and second slidable parts are elongate U-shaped members, the open ends of which slidably receive each other in an overlapping arrangement so that their overall length can be adjusted, thereby enabling one to adjust the overall length of the cross support.

15. An adjustable grate as claimed in claim 14 wherein each elongate U-shaped member is formed from flat metal bar.

16. A grate as claimed in claim 1 further comprising securing means for securing said grate to a window well.

17. A grate as claimed in claim 16 wherein said securing means includes a plurality of L-shaped members, each of which has a free end attached to an end of one of said elongate members and an L-shaped opposite end for hooking engagement with the side wall of a window well.

18. A grate as claimed in claim 17 wherein said L-shaped member is made from flat metal bar and wherein the free end of each L-shaped member is bolted to an end of one of said elongate members.

* * * * *